US008728251B2

(12) United States Patent
Greber

(10) Patent No.: US 8,728,251 B2
(45) Date of Patent: May 20, 2014

(54) TREATMENT SOLUTION FOR COATING METAL SURFACE

(75) Inventor: Stephanie Greber, Oberviechtach (DE)

(73) Assignee: Bulk Chemicals, Inc., Reading, PA (US)

( * ) Notice: Subject to any disclaimer, the term of this patent is extended or adjusted under 35 U.S.C. 154(b) by 209 days.

(21) Appl. No.: 12/962,132

(22) Filed: Dec. 7, 2010

(65) Prior Publication Data

US 2011/0132497 A1 Jun. 9, 2011

(30) Foreign Application Priority Data

Dec. 8, 2009 (DE) ..... 10 2009 044 821

(51) Int. Cl.
*C23C 22/44* (2006.01)
*C23C 22/34* (2006.01)

(52) U.S. Cl.
USPC ..... 148/247; 148/243; 148/274

(58) Field of Classification Search
CPC ..... C23C 22/34; C23C 22/40; C23C 22/44
USPC ..... 148/247, 274
See application file for complete search history.

(56) References Cited

U.S. PATENT DOCUMENTS

| | | | | |
|---|---|---|---|---|
| 4,298,404 | A | 11/1981 | Greene | |
| 6,027,578 | A | 2/2000 | Marzano | |
| 6,060,122 | A | 5/2000 | Rossmaier | |
| 2003/0213533 | A1 * | 11/2003 | Sako et al. | 148/243 |
| 2004/0112470 | A1 * | 6/2004 | Meagher et al. | 148/247 |
| 2008/0302448 | A1 | 12/2008 | Frey et al. | |
| 2009/0214883 | A1 | 8/2009 | De Zeeuw et al. | |

FOREIGN PATENT DOCUMENTS

| | | | |
|---|---|---|---|
| AT | 193861 | B | 12/1957 |
| DE | 30 31 270 | A1 | 3/1981 |
| DE | 195 10 825 | A1 | 9/1996 |
| DE | 10 2005 059 314 | A1 | 6/2007 |
| DE | 10 2006 039 633 | A1 | 3/2008 |
| WO | WO-01/86016 | A2 | 11/2001 |

* cited by examiner

*Primary Examiner* — Lois Zheng
(74) *Attorney, Agent, or Firm* — RatnerPrestia

(57) ABSTRACT

A chromium-free aqueous treatment solution for coating metal surfaces is described. The treatment solution contains fluorocomplex ions of titanium and/or zirconium and molybdate ions, vanadium ions and one or more aromatic carboxylic acids with at least one carboxyl groups and at least two further functional groups, wherein the two further functional groups are selected from the group comprising carboxyl groups, hydroxyl groups, amino groups and nitro groups.

18 Claims, No Drawings

TREATMENT SOLUTION FOR COATING METAL SURFACE

This application claims priority to German patent application DE 10 2009 044 821.7, filed Dec. 8, 2009.

FIELD OF THE INVENTIONS

The invention relates to chromium-free aqueous treatment solutions for coating metal surfaces.

BACKGROUND OF THE INVENTIONS

In the past, chromium-containing passivating layers were used predominantly to prevent the corrosion of metallic materials. In this connection, the particularly poisonous and carcinogenic yellow chromating was displaced increasingly by the somewhat less hazardous green chromating. The very good corrosion-inhibiting properties of such coatings based on chromium are confronted by the hazardous and environment-contaminating potential. In production and use, expensive effluent treatment methods are required in order to be able to comply with the required limiting values for chromate ions.

The mentioned disadvantages of passivating layers based on chromium led to intensive efforts to develop chromium-free corrosion inhibitors. For example, the DE 10 2006 039 633 A1 discloses a chromium-free corrosion inhibitor with a pH ranging from 1 to 3 which, aside from water and fluorocomplex ions of titanium and/or zirconium, contains also at least one corrosion inhibiting pigment and at least one organic polymer, which is water soluble or water dispersible in the pH range mentioned and which, as such, has a pH ranging from 1 to 3 at a concentration of 50% by weight in an aqueous solution. In addition, phosphate ions, manganese ions, magnesium ions, molybdate ions, tungstenate ions, zinc ions, cobalt ions, nickel ions, vanadium ions and iron Ions may be present. Said water dispersible organic polymer may contain carboxyl groups as functional groups.

The DE 10 2005 059 314 A1 discloses an acidic, chromium-free aqueous solution of a fluorocomplex of at least one element selected from the group comprising boron, silicon, titanium, zirconium and hafnium with a pH within the range of 2 to 5.5, one or more components selected from the group comprising tin ions and bismuth ions, buffer systems for a pH ranging from 2.5 to 5.5, aromatic carboxylic acids with at least two groups, which contain donor atoms, or derivatives of such carboxylic acids being present in addition. As carboxylic acids, phthalic acid, salicylic acid, o-aminobenzoic acid and o-nitrobenzoic acid are mentioned.

The DE 30 31 270 A1 discloses an aqueous, acidic bath for passivating a metal substrate with an organic activation agent, wherein the organic activation agent is selected from the group of carboxylic acids, bath-soluble derivatives thereof and combinations thereof, in combination with one or more bath-soluble, film-forming materials, of which at least one chromium-free film-forming material is from the group of fluoride salts, oxalate salts, malonate salts, succinate salts and combinations thereof, wherein the chromium-free, film-forming material includes a film-forming element, which is not chromium and which forms a thin, adherent, coherent, hydrophobic, passivating coating on the metal substrate, wherein the film-forming element may be aluminum, silicon, titanium, vanadium, iron, cobalt, molybdenum, cerium and combinations thereof. As carboxylic acid, polyhydroxy carboxylic acids and polycarboxylic acids are named.

The search for a chromium-free corrosion inhibitor is made difficult by the fact that the passivating layer must have a coloration. It is necessary to produce a colored layer in order to be able to check the production in industrial use quickly, simply and visually. Only in this way is it possible to evaluate the quality of the coating without an expensive testing method and to ensure a frictionless, trouble-free course of the production.

Therefore, there continues to be a need for chromium-free compositions for coating metal substrates, which bring about sufficient protection against corrosion and, in addition, produce coloration on the metal surface, which can easily be verified visually.

SUMMARY

A chromium-free, aqueous treatment solution for coating metal surfaces is to be provided, by means of which adequate corrosion protection is to be brought about and a coloration, which can easily be verified visually, is produced on the metal surface. According to the invention, this objective is accomplished by a chromium-free, aqueous treatment solution for coating metal surfaces of the independent claim 1. Further advantageous aspects, details and embodiments of the invention arise out of the dependent claims and the specifications.

The present invention makes a chromium-free, aqueous treatment solution for coating metal surfaces available. The inventive treatment solution contains fluorocomplex ions of titanium and/or of zirconium, molybdate ions, vanadium ions and one or more aromatic carboxylic acids with at least one carboxyl group and at least two further functional groups, wherein the two further functional groups selected from the group comprising carboxyl groups, hydroxyl groups, amino groups and nitro groups.

Surprisingly, it has now been shown by experimental investigations that excellent corrosion protection for metallic surfaces as well as a visually easily perceivable golden coloration of the surfaces is brought about by an aqueous treatment solution, which contains a combination of the components, fluorocomplex ions of titanium and/or zirconium, molybdate ions, vanadium ions and at least one aromatic carboxylic acid with at least one carboxyl group and at least two further functional group selected from carboxyl groups, hydroxyl groups, amino groups and nitro groups. The inventive treatment solution therefore, outstandingly fulfills all the requirements which are to be met by corrosion inhibitors for metal substrates.

The experimental investigations confirm that especially the combination of fluorocomplex ions of titanium and aromatic carboxylic acid is responsible for the coloration of the metallic surfaces. Only in combination do the molybdate ions and vanadium ions improve the corrosion protection, the coloration hardly being affected. The aromatic carboxylic acid has a clear effect on the corrosion protection, since it is associated with a decrease in the amount of inferior corrosion properties. In particular, no coloration is produced on the metal substrates if the aromatic carboxylic acid is omitted completely.

Within the scope of the present invention, the concepts of "coating," "passivation layer," "passivation coating" and "corrosion-inhibiting coating" are used synonymously. In particular, a "coating" is also understood to be a passivation layer as corrosion protection and not only a paint coating.

In accordance with a particularly preferred embodiment of the present invention, the treatment solution contains fluorocomplex ions of titanium and zirconium. Experimental investigations have shown that, admittedly, if only one of the two components is present, a certain corrosion protection is already achieved. However, a clearly improved corrosion protection is attained if the fluorocomplex ions of titanium, as well as the fluorocomplex ions of zirconium, are present in the treatment solution.

The experimental investigations show that it is especially the particular combination of the chemical compounds, fluorocomplex ions of titanium and/or zirconium, molybdate ions, vanadium ions, and one or more aromatic carboxylic acids with at least one carboxyl groups and at least two further functional groups, contained in the inventive, aqueous treatment solution, wherein the two further functional groups are selected from the group comprising carboxyl groups, hydroxyl groups, amino groups, and nitro groups, which brings about a coloration of the substrate surfaces, which is easily perceivable visually as well as an excellent corrosion protection for the metallic substrate.

The inventive treatment solution is suitable particularly for the first coating of a metallic surface. This means that the metallic surface was not subjected to any other treatment to protect it against corrosion, before it was contacted with the inventive corrosion inhibitor. Rather, the inventive treatment solution is brought into contact with a freshly produced or freshly cleaned metal surface. In this connection, contact with the inventive treatment solution represents the first or only corrosion protection measure for the metal surface. Of course, after the use of the inventive corrosion protection agent, further decorative and/or corrosion inhibitor, such as the usual dip, spray or powder paints, can be applied on the metal surface.

The fluorocomplex ions of titanium and/or zirconium preferably are hexafluorocomplex ions. These may be added in the form of their free acids or in the form of their soluble salts to the inventive treatment solution. For adjusting the pH to an acidic value, it is advantageous to introduce the fluorocomplex ions as hexafluoro acids. On the average, the fluorocomplex ions may also contain fewer than 6 fluorine atoms per complex molecule. This may be achieved, for example, by using, in addition to the hexafluorocomplex ions, further compounds or salts of titanium and/or zirconium ions, which can form fluorocomplexes. Examples of this are oxide carbonates or hydroxycarbonates. Likewise, the treatment solution may contain free fluoride ions, which are in excess of those required for the presence of hexafluorocomplex ions and may be added, for example, in the form of hydrofluoric acid.

The inventive treatment solution usually is produced from concentrates, which are commercially available. As a rule, the concentrate is diluted with deionized water, 2% by weight of concentrate being diluted with 98% by weight of deionized water.

Preferably, the components a) "fluorocomplex ions of titanium and/or zirconium" are added to the treatment solution in an amount of 0.001% by weight up to 0.2% by weight and preferably in an amount of 0.005% by weight up to 0.1% by weight and particularly in an amount of 0.01% by weight to 0.04% by weight and more particularly in an amount of approximately 0.03% by weight in the form of a salt or of the free acid. The amounts of component a) "fluorocomplex ions of titanium and/or zirconium," are given in percent by weight of the salts used or of the free acid used, based on the total weight of the treatment solution produced from a concentrate.

Preferably, the molybdate ions are added to the treatment solution in the form of sodium molybdate or ammonium heptamolybdate.

According to a further, particularly preferred embodiment, the component b) "molybdate ions" is added to the treatment solution in the form of a salt in an amount of 0.0002% by weight to 0.02% by weight, preferably in an amount of 0.001% by weight to 0.01% by weight and more preferably in an amount of 0.002% by weight to 0.006% by weight. The amounts of component b) molybdate ions are given in % by weight of the salts used based on the total weight of the treatment solution produced from the concentrate.

According to a further, preferred embodiment of the present invention, the vanadium ions are added to the treatment solution in the form of sodium vanadate or ammonium vanadate.

According to a further, particularly preferred embodiment, the component c) "vanadium ions" is added in the form of a salt to the treatment solution in an amount of 0.0002% by weight to 0.02% by weight, preferably in an amount of 0.0001% by weight to 0.02% by weight and more preferably in an amount of 0.001% by weight to 0.01% by weight. The amounts by weight of the component b) "vanadium ions" are given in percent by weight of the salt used, based on the total weight of the treatment solution produced from a concentrate.

Preferably, one or more aromatic carboxylic acids with at least one carboxyl group and at least two hydroxyl groups are contained in the treatment solution. If at least one aromatic carboxylic acid with at least one carboxyl group and at least two hydroxyl groups is used, a particularly resistant and, at the same time, visually clearly identifiable conversion layer is obtained.

Particularly preferably, the treatment solution contains one or more aromatic carboxylic acids with at least one carboxyl group and three hydroxyl groups. If at least one aromatic carboxylic acid with at least one carboxyl group and three hydroxyl groups is used, a coating is obtained, which inhibits corrosion even more and, at the same time, is colored distinctly.

According to a further, particularly preferred embodiment of the present invention, gallic is contained in the treatment solution. When gallic acid is used, excellent corrosion protection and a clearly identifiable gold-colored conversion layer is obtained.

According to a further, particularly preferred embodiment of the present invention, the treatment solution contains the component d) "one or more aromatic carboxylic acids with at least one carboxyl group and at least two further functional groups, wherein the two further functional groups are selected from the group comprising carboxyl groups, hydroxyl groups, amino groups and nitro groups" in an amount of 0.001% by weight to 0.02% by weight, preferably in an amount of 0.002% by weight to 0.01% by weight and more preferably in an amount of 0.004% by weight to 0.008% by weight, based on the total weight of the treatment solution produced from a concentrate.

In addition to these components, further active ingredients or auxiliary materials may be present, such as polymers and/or attitudes having a dispersing effect. Of course, the proportions of the individual components have to be selected so that they add up to 100% by weight. In this connection, it should be noted that counter ions, corresponding to the ionic components mentioned, must be present. For example, the molybdate and vanadium ions preferably used as ammonium or alkali metal salts.

The inventive treatment solution shall contain as little as possible in the way of organic compounds, such as organic solvents, which are volatile under the conditions of the after treatment process and which are emitted to the environment as volatile organic carbon "VOC". Accordingly, the treatment solution preferably does not contain more than 5% by weight, especially not more than 2% by weight and, particularly, not more than 0.5% by weight of organic compounds, which have a boiling point of up to 150° C. at atmospheric pressure.

The inventive treatment solution represents a ready-for-use product, which can be brought into contact with the metal substrate without further preparatory measures. The treatment solution can be obtained on the market usually as a concentrate. As a rule, the concentrate is diluted with deionized water, 2% by weight of concentrate being diluted with 98% by weight of deionized water.

The present invention also comprises a concentrate for the preparation of one of the treatment solutions described above and the treatment solution can be produced by diluting the concentrate with water. The concentrate has a lesser volume than the treatment solution and a lower weight, which leads to corresponding advantages during transport and storage.

According to a preferred embodiment, the concentrate is diluted with water for the preparation of the treatment solution in a proportion of 0.5% by weight to 5% by weight, preferably in a proportion of 1% by weight to 3% by weight and particularly in a proportion of approximately 2% by weight, based on the total weight of the treatment solution. In particular, the concentrate is diluted with deionized water.

Depending on particular composition, the inventive treatment solution is stable for a certain time, which is limited by the formation of a precipitate. As a rule, however, the ready-for-use treatment solution is stable for a time sufficient for use in the production process.

Someone of ordinary skill in the art is aware that the components, named above, especially the inorganic compounds, can enter into reactions with one another, so that they are finally present in the treatment solution in a form, in which they are stable in the pH range indicated. For example, the fluorocomplex ions are present partly in the form of the free acid.

When used on metal surfaces, the treatment solution is applied in a known manner by dipping or spraying. This application of the chromium-free passivation is followed by a procedure, in which the surface is rinsed or treated with a fine mist. Under certain circumstances, it is possible to employ the method without a subsequent rinsing procedure (good rinsing qualities). Use of the treatment solution by a coil-coating method is also conceivable. The solution is applied preferably at temperatures between 10° and 50° C. and especially at temperatures between 15° and 35° C. This temperature can be reached by supplying heat over the substrate, which is to be coated, or over the treatment solution.

The present invention also comprises a method for coating metal surfaces, wherein the metal surface is dipped for a period up to 180 seconds and preferably up to 120 seconds into an inventive treatment solution, the treatment solution having a pH of 2.0 to 4.0, preferably of 2.3 to 3.5 and particularly of 2.6 to 2.9.

The present invention also comprises methods for coating metal surfaces, wherein the metal surface is dipped for a period of up to 180 seconds and preferably of up to 120 seconds into an inventive treatment solution, which has a pH of 2.0 to 4.0, preferably of 2.3 to 3.5 and particularly of 2.4 to 2.8.

The present invention also comprises a method for coating metal surfaces, for which the metal surface is sprayed for a period of up to 120 seconds and preferably of up to 90 seconds with an inventive treatment solution, which has a pH of 3.0 to 5.0, preferably of 3.3 to 4.5 and particularly of 3.5 to 4.0.

The coating with the inventive treatment solution represents the first corrosion protection measure. This means that either a freshly produced or a freshly cleaned metal surface, which has not been subjected to any other corrosion protection measure, is brought into contact with the inventive treatment solution.

The pre-treatment of the metal surface before it is brought into contact with the treatment solution, preferably is carried out in an acidic pickling degreasing procedure followed by rinsing steps or an alkaline pickling degreasing procedure followed by rinsing steps. It is particularly preferred if the last rinsing step before the surface is brought into contact with the treatment solution is carried out with deionized water.

In this way, a metal surface is obtained, which has a corrosion protection coating base. The metal substrate can be stored and shipped in this form. It may furthermore be cut into parts and optionally worked and assembled with other parts into standardized components. Metal surfaces, treated with the inventive treatment solution, may also be marketed and processed further, without having to apply a further coating on the corrosion inhibitor. Depending on the intended use, further powder or wet paint coatings, especially polyester or epoxy powder paints, or also further corrosion inhibiting coatings may be applied after the final metal object has been produced.

The inventive method is particularly suitable for coating metal substrates, which are selected from substrates of zinc or zinc alloys, aluminum or aluminum alloys as well as steel substrates, which are coated with zinc or zinc alloys or with aluminum or aluminum alloys. In this connection, "zinc alloys" or "aluminum alloys are understood to be alloys, which consists of more than 50 atom percent of zinc or aluminum. Steel substrates, coated with zinc or zinc alloys, may be coated with zinc or zinc alloys either electrolytically or by a melt dipping method. Moreover, the zinc alloys, deposited on steel surfaces, may have a high aluminum content or the deposited aluminum alloys may have a high zinc content.

DETAILED DESCRIPTION OF THE INVENTIONS

For the purpose of producing treatment solutions used in the examples and comparison examples explained in greater detail in the following, gallic acid was first of all dissolved with stirring and heating to 37° C. in fully deionized water. After that, the compounds containing titanium and/or zirconium were added. Subsequently, the compounds, containing molybdenum and vanadium, were added with stirring. When the vanadium is added, the color of the solution changes to a dark brown. When molybdenum is then added, the color changes to red.

Aluminum substrates in the form of AlMg1 sheet metal alloy were used as metallic substrates. Before they were bought into contact with the treatment solution, the metallic substrates were pretreated by a dipping method, by means of which coarse contamination, such as fats and oils, were removed by an acidic pickling degreasing. After the pickling degreasing, the substrates were rinsed and finally dried with the help of a dry-off oven at approximately 100° C.

Subsequently, the aluminum substrates was passivated by the dipping process for 3 minutes at room temperature, followed by rinsing with deionized water.

In order to test the quality of the passivation achieved, an acetic acid salt spray and a filiform corrosion test were carried out with powder paint-coated metal substrates according to the corresponding DIN regulations. Results were obtained more quickly and equally meaningfully with a steady-state potential analysis of the uncoated, passivated substrate. For this purpose, a correlation between the acetic acid salt spray test and the steady-state potential analysis was determined in a preparatory series of experiments.

For carrying out the steady-state potential analysis, a rubber seal was glued onto a passivated and subsequently dried aluminum substrate and a glass vessel without a bottom was placed on the rubber seal. This vessel is now filled with 50 mL of borax solution, which functions as inhibitor. Uniform mixing is ensured by a magnetic stirrer under the substrate and a corresponding stir bar in the glass vessel. A KCl electrode dips into the inhibitor solution as reference electrode. A specific steady-state potential, which depends on the material substrate to be tested, sets in under these conditions. If the passivation layer is inactive, the potential values are clearly more positive than in the case of bare aluminum. If the passivation layer is damaged by contaminants, which have been added, the potential shifts into the negative range. This is shown in the measurement as a potential jump.

As contaminant, which is to show the destruction of the corrosion-inhibiting coating, dosages of 0.1 μL of a 3 molar NaCl solution are added sequentially to the borax solution. After one hour, within which the steady state potential has set in, NaCl solution is added for the first time and subsequently every fifteen minutes. After 3 hours, it is added six times at 10 minute intervals and subsequently at 5 minute intervals, until finally the corrosion-preventing coating finally breaks down. The damage to the corrosion-preventing coating can be recognized by a jump in potential of at least 20 mV.

If the potential jump sets in within the first 1.5 hours of the measurement, the corrosion protection is qualitatively poor. If the potential jump occurs after 1.5 to 3.0 hours, it can be assumed that the corrosion protection is good. If the potential jump occurs at a later time, the corrosion protection is very good.

The contents and their concentrations in the treatment solution for the following Examples and comparison Examples, which are described in greater detail, are summarized in Table 1.

TABLE 1

| Composition of the treatment solutions used (in % by weight based on the total weight of the concentrate of the treatment solution) | | | | | | | | |
|---|---|---|---|---|---|---|---|---|
| Contents | Ex. 1 | Ex. 2 | Ex. 3 | Ex. 4 | Ex. 5 | Ex. 6 | Comp. Ex. 1 | Comp. Ex. 2 |
| Hexafluoro titanic acid (50%) | 3.0 | 3.0 | 1.0 | 1.0 | 3.0 | — | 3.0 | 3.0 |
| Hexafluoro zirconic acid (50%) | 3.0 | 3.0 | 3.0 | 3.0 | 3.0 | 4.0 | 3.0 | 3.0 |
| Sodium molybdate | 0.2 | — | 0.2 | — | 0.2 | 0.2 | 0.2 | — |
| Ammonium hepta-molybdate | — | 0.2 | — | 0.2 | — | — | — | — |
| Sodium vanadate | 0.2 | — | 0.2 | — | 0.2 | 0.2 | — | 0.2 |
| Ammodium vanadate | — | 0.2 | — | 0.2 | — | — | — | — |
| Gallic Acid | 0.4 | 0.4 | 0.4 | 0.4 | 0.2 | 0.4 | 0.4 | 0.4 |
| Deionized water | 93.2 | 93.2 | 95.2 | 95.2 | 93.4 | 95.2 | 93.6 | 93.6 |

For the preparation of the actual treatment solution, the concentrates were diluted to have a concentration of 2% by weight in deionized water.

Example 1

The treatment solution, used for Example 1, results in a metal substrate with a golden yellow coating. A steady-state potential analysis shows a potential jump after more than 7 hours and, with that, outstanding corrosion protection.

Comparison Example 1

This formulation contained no vanadium ions, in order to test the effect of the latter on corrosion protection and coloration. Admittedly, the coated metal surface has a golden coloration. However, in spite of intensive cleaning and several experimental passages, it was not possible to produce a uniform layer. Instead, in every case, colorless spots were visible on the metal surface. The potential jump after 2.5 hours in the steady state potential analysis shows that the corrosion protection is clearly inferior to that of Example 1.

Comparison Example 2

This formulation contained no molybdate ions in order to test the effect of these on corrosion protection and coloration. The coated metal surface had a uniformly golden coloration. The corrosion protection was shown to be clearly inferior to that of Example 1 by the steady state potential analysis, in which a potential jump occurred already after 3.0 hours.

Example 2

It was checked whether the coloration and corrosion protection depends on the cations of the vanadium and molybdenum compounds used. The sodium vanadate and sodium molybdate, used in Example 1, were therefore replaced by their ammonium equivalents. The coated aluminum substrates had a golden coloration, which was identical to that of Example 1. The corrosion protection was as good as that achieved when sodium vanadate and sodium molybdate were used.

Example 3

In this experiment, the effect of hexafluorotitanic acid was tested and its concentration in the treatment solution was reduced to ⅓ of that in Example 1. The coloration of the coated metal substrate was less pronounced and only a slight yellow shimmer could be recognized. The steady state potential analysis showed a potential jump after 4.5 hours.

Example 4

The experiment of Example 3 was repeated. However, sodium vanadate and sodium molybdate were replaced by their ammonium equivalents. In comparison to Example 1, the coated metal substrate had a clearly weaker coloration. The corrosion protection was very good. The steady state potential analysis showed a potential jump after 5.5 hours.

Example 5

In this case, the proportion of gallic acid was half of that in Example 1, in order to investigate its effect on corrosion protection and coloration. The coloration of the coated metal substrate was hardly affected and remained almost identically intensive. However, the corrosion protection decreased somewhat as indicated in the steady state potential analysis by a potential jump after 4.0 hours.

Example 6

In this case, the hexafluorotitanic acid was omitted completely in order to investigate its effect on corrosion protection and on coloration. It was practically not possible to identify any coloration of the coated metal substrate. In addition, the corrosion protection was noted to be clearly inferior, as shown by a potential jump after 4.0 hours.

I claim:

1. A chromium-free aqueous treatment solution for coating metal surfaces consisting of:

fluorocomplex ions of titanium or zirconium or a combination thereof;

molybdate ions;

vanadium ions; and one or more aromatic carboxylic acids with at least one carboxyl group and at least two further functional groups, wherein the two further functional groups are selected from the group consisting of carboxyl groups, hydroxyl groups, amino groups and nitro groups.

2. The treatment solution of claim 1, wherein the at least two further functional groups are at least two hydroxyl groups.

3. The treatment solution of claim 1 wherein the at least two further functional groups are three hydroxyl groups.

4. The treatment solution of claim 1, wherein the one or more aromatic carboxylic acids with at least one carboxyl group and at least two further functional groups is gallic acid.

5. The treatment solution of claim 1, wherein the molybdate ions are sodium molybdate or ammonium molybdate.

6. The treatment solution of claim 1, wherein the vanadium ions are sodium vanadate or ammonium vanadate.

7. The treatment solution of claim 1, wherein the one or more aromatic carboxylic acids are present in the treatment solution in an amount of 0.001% by weight to 0.02% by weight, based on the total weight of the treatment solution.

8. The treatment solution of claim 1, wherein the flurocomplex ions of titanium or zirconium or combination thereof are fluorocomplex ions of titanium and fluorocomplex ions of zirconium.

9. The treatment solution of claim 1, wherein the vanadium ions are present in an amount of between about 0.001% and 0.020% by weight based on the total weight of the treatment solution.

10. The treatment solution of claim 1, wherein the vanadium ions are present in an amount of between about 0.001% and 0.010% by weight based on the total weight of the treatment solution.

11. The treatment solution of claim 1, wherein the molybdate ions are present in an amount of between about 0.002% and 0.020% by weight based on the total weight of the treatment solution.

12. The treatment solution of claim 1, wherein the molybdate ions are present in an amount of between about 0.002% and 0.006% by weight based on the total weight of the treatment solution.

13. A concentrate for producing a treatment solution of claim 1, wherein the treatment solution is produced by diluting the concentrate with water.

14. The concentrate of claim 13, wherein the concentrate is diluted with water, so that it is present in an amount of 0.5% by weight to 5% by weight based on the total weight of the treatment solution.

15. A method for coating a metal surface, comprising dipping the metal surface for a period of up to 120 seconds in a treatment solution of claim 1, the treatment solution having a pH of 2.0 to 4.0.

16. The method of claim 15, further comprising that the metal surface is selected from the group comprising surfaces of zinc, zinc alloys, aluminum, aluminum alloys, zinc-coated steel, zinc with an aluminum alloy.

17. A method for coating a metal surface, comprising spraying the metal surface for a period of up to 120 seconds in a treatment solution of claim 1, the treatment solution having a pH 3.0 to 5.0.

18. The method of claim 17, further comprising that the metal surface is selected from the group comprising surfaces of zinc, zinc alloys, aluminum, aluminum alloys, zinc-coated steel, zinc alloy-coated steel, steel coated with aluminum and steel coated with an aluminum alloy.

* * * * *